United States Patent [19]

Giuliani et al.

[11] Patent Number: 4,632,081

[45] Date of Patent: Dec. 30, 1986

[54] GIULIANI MODULAR ENGINE IMPROVEMENT

[76] Inventors: Robert L. Giuliani, P.O. Box 30862, Honolulu, Hi. 96820; Mark A. Giuliani; Karen A. Giuliani, both of 45-310 Akimala Pl., Kaneohe, Hi. 96744

[21] Appl. No.: 519,089

[22] Filed: Aug. 1, 1983

[51] Int. Cl.[4] ..... F02D 17/02; F02B 75/26

[52] U.S. Cl. ..... 123/198 F; 123/58 A; 123/DIG. 6; 123/DIG. 7; 123/DIG. 8

[58] Field of Search ..... 123/DIG. 6, DIG. 7, 123/DIG. 8, 198 F, 197 AB, 58 R, 58 A, 58 AB

[56] References Cited

U.S. PATENT DOCUMENTS

| | | | |
|---|---|---|---|
| 868,497 | 10/1907 | Smith | 123/58 R |
| 1,147,313 | 7/1915 | Desort | 123/58 A |
| 1,246,272 | 11/1917 | Hutchinson | 123/DIG. 6 |
| 1,802,902 | 4/1931 | Brau | 123/198 F |
| 1,945,727 | 2/1934 | Braunwalder | 123/58 R |
| 2,065,790 | 12/1936 | Braunwalder | 123/58 R |
| 2,291,636 | 8/1942 | Kiczales et al. | 123/198 F |
| 2,452,232 | 10/1948 | Fischer | 123/DIG. 7 |
| 2,454,612 | 11/1948 | Paxman | 123/DIG. 6 |
| 4,023,542 | 5/1977 | Ango | 123/58 R |
| 4,069,803 | 1/1978 | Cataldo | 123/198 F |
| 4,367,703 | 1/1983 | Maucher et al. | 123/198 F |
| 4,368,701 | 1/1983 | Huber et al. | 123/198 F |
| 4,373,481 | 2/1983 | Krüger et al. | 123/198 F |
| 4,389,985 | 6/1983 | Huber et al. | 123/198 F |
| 4,394,854 | 7/1983 | Huber | 123/198 F |

FOREIGN PATENT DOCUMENTS

| | | | |
|---|---|---|---|
| 1195776 | 11/1959 | France | 123/DIG. 6 |

*Primary Examiner*—Ira S. Lazarus

[57] ABSTRACT

This invention is an improved modular engine having replaceable power modules wherein the improvement consists of automatically coupling and decoupling the power modules and the engine's power output shaft in response to immediate operating requirements resulting in fuel savings. When a unit is decoupled, it is shut down and does not use fuel or add load to the engine. This feature saves fuel whenever operating requirements permit a reduction in power. The power units may be of several types known to the art. The power units are shown to have a gear which meshes with a gear part of the engine's power output shaft to drive the shaft. A microprocessor is shown to control the dynamic coupling and decoupling between the unit's gear and the power output shaft to keep the invention properly timed and fuel efficient. A flywheel is shown, in combination with the other parts, to store regenerated energy and release the energy to the power shaft upon demand. This feature of the invention provides an additional fuel savings.

19 Claims, 5 Drawing Figures

GIULIANI MODULAR ENGINE IMPROVEMENT

FIELD OF THE INVENTION

This invention is in the field of computer controlled modular engines having easily disconnectable and replaceable power modules. A reduction gear may be included in combination with the power modules. A flywheel may be incorporated to conserve regenerated energy.

BACKGROUND OF THE INVENTION

Earlier attempts have been made to depower selected cylinders in internal combustion engines in response to changing operating power requirements. The well known Jacobson engine inhibits fuel flow to combustion chambers to allow deceleration of a vehicle without consuming fuel, however, the pistons continue to reciprocate. Beyond this limited application, it offers no real advantage.

Cadillac's Modulated Displacement Engine[1], used on the 1981 DeVille, Brougham and Eldorado is another example. This engine was prone to mechanical and electronic failures. More recently, the Alfa Romeo Alfetta I[2] has attempted a very similar technique and claims to surmount Cadillac's problems with better electronics. Neither of these techniques addresses the need to selectively depower cylinders and pistons by dynamically uncoupling the piston from the crankshaft and effect timely coupling when increased power is needed. In the present invention, the piston is stationary in its cylinder when decoupling is effected, unlike previous attempts where the piston remains coupled to the crankshaft to add wear and load to the engine. In the present invention, dynamic recoupling is effected so that there is proper timing with the other engine components. This has been an insurmountable obstacle in earlier attempts and, to the inventors' knowledge, this problem has never before been solved.

The related earlier application (Ser. No. 416,454) discloses the technique of manually removing, or adding, power units to couple them to the engine's power output shaft.

The past art is replete with efforts to incorporate a flywheel's energy storage ability into a vehicle's engine to capture regenerated energy[3,4,5]. So far, these efforts have been impractical with piston engines primarily because of weight and space limitations and the complexity of the flywheel/drivetrain interface. The present invention overcomes these objections with a simple, direct interface between the flywheel and the output power shaft.

It is well known that microprocessors are practical for automatically controlling various of the operating elements of conventional engines. Several prior U.S. patents show this technique. Examples are: U.S. Pat. Nos. 4,282,947, 3,886,810 and 4,259,723. However, none of the prior art teaches the novel and useful combination and arrangement of microprocessors, replaceable power modules, flywheel and output power shaft to effect a more efficient, easily maintained engine.

REFERENCES CITED:

U.S. PATENT DOCUMENTS

| | | | |
|---|---|---|---|
| U.S. Pat. No. 416,454 | 10/1982 | GIULIANI | |
| 4,301,776 | 11/1981 | Fleming | 123-197AC |

-continued

REFERENCES CITED:

| | | | |
|---|---|---|---|
| 4,313,404 | 2/1982 | Kossel | 123-58BB |
| 4,352,345 | 10/1982 | Menard et al. | 123-414 |

OTHER PUBLICATIONS

1. Chilton's Auto Manual, 1974, pp. U419, U420
2. Motor Imported Car Manual, 3rd Ed, pp. I827, I828
3. Popular Science, Feb 1983, p. 64, Oct 1980

SUMMARY OF THE INVENTION

This invention is an improvement to the inventor's earlier modularized Engine, U.S. Ser. No. 416,454. It teaches a combination of replaceable power modules; output power shaft; microprocessor; and flywheel to comprise a high power, fuel efficient and easily maintained engine.

The power units are attached to the engine's housing so that they are easily removeable and replaceable as units. They may be of different types which are capable of driving an output power means. This means could be a gearwheel. It is selectively shiftable to engage and disengage with the power output shaft under control of a microprocessor. The engaging and disengaging can be done by the microprocessor in response to operator or operational demands.

A flywheel is shown coupled to the output power shaft by a clutch which is also controlled by the microprocessor so that regenerated energy can be automatically stored or drained to the power train in synchronization with the energy obtained from the power units. A means to allow operator override of the processor is disclosed.

It is an object of the invention to simplify repairs and reduce engine downtime.

Another object is to effect fuel savings by dynamically decoupling power units from the output power shaft and recouple the units when power is needed.

Another object is to allow an operator to override the automatic control of the engine.

Another object is to directly couple a flywheel to the drive train in combination with other invention components in a simple way that allows the flywheel to efficiently recover regenerated energy.

Another object is automatic synchronization of a flywheel's energy storage ability with one or more energy producing power units by a processor to effect very efficient fuel consumption.

Another object is to provide very high torque power at the engine's output power shaft.

Another object is to eliminate the transmission from the power train of a helicopter while providing high torque power to the rotor shaft.

Other objects and advantages of the invention will become apparent from the following description together with the referenced drawings.

DESCRIPTION OF THE PREFERRED EMBODIMENTS

This disclosure reveals a variation of the preferred embodiment of this invention that is particularly adaptable for positioning over the drive axles such as a front wheel drive car. This variation is also ideally suited to helicopter engines. It provides the very high torque power requisite at the main power shaft and eliminates the need for the heavy transmission found in conventional helicopters. At least a second variation will be obvious to those skilled in the art by considering FIG. 5 herein.

Figure 3:
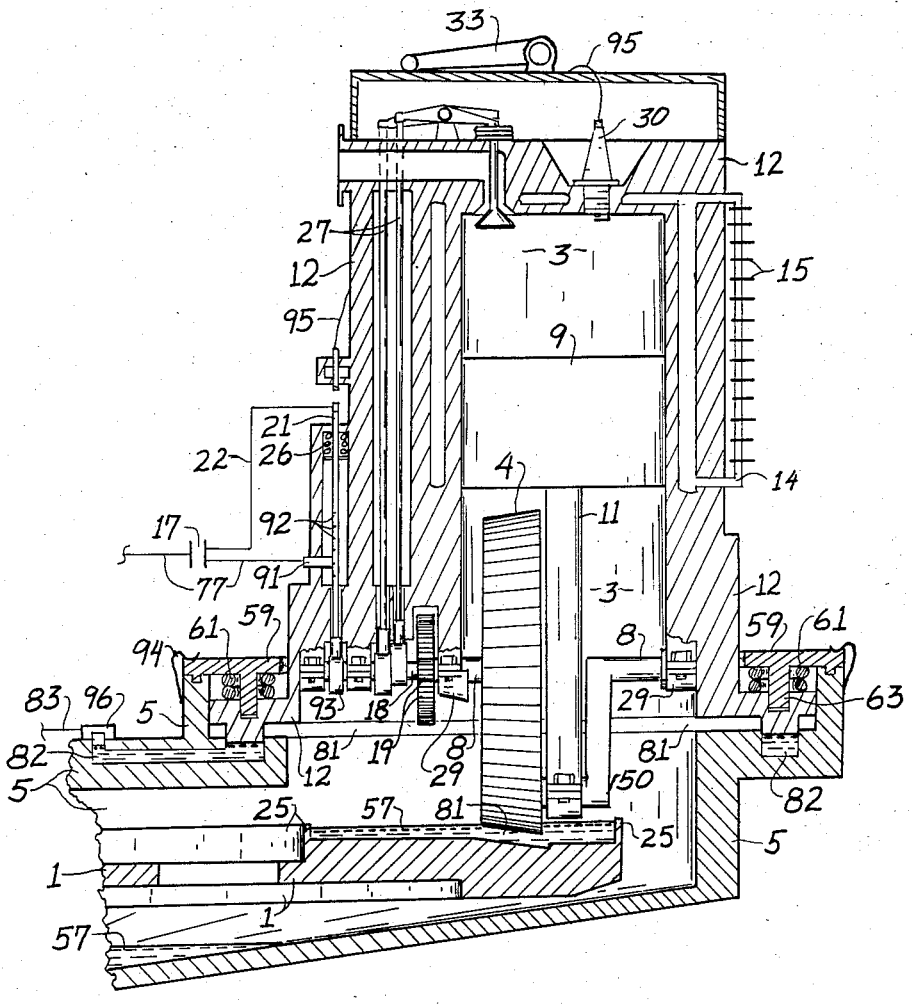
FIG. 3 is the same view of the power module to the right of line B—B in FIG. 2 but shown in greater detail.

While the power unit 12 of the present invention may be rotary or it may be single cylinder gas or diesel engine designed for two- and four-cycle operation, a single cylinder four cycle gasoline engine has been selected for the detailed description of the power unit 12, particularly shown in FIG. 3 herein.

Figure 1:
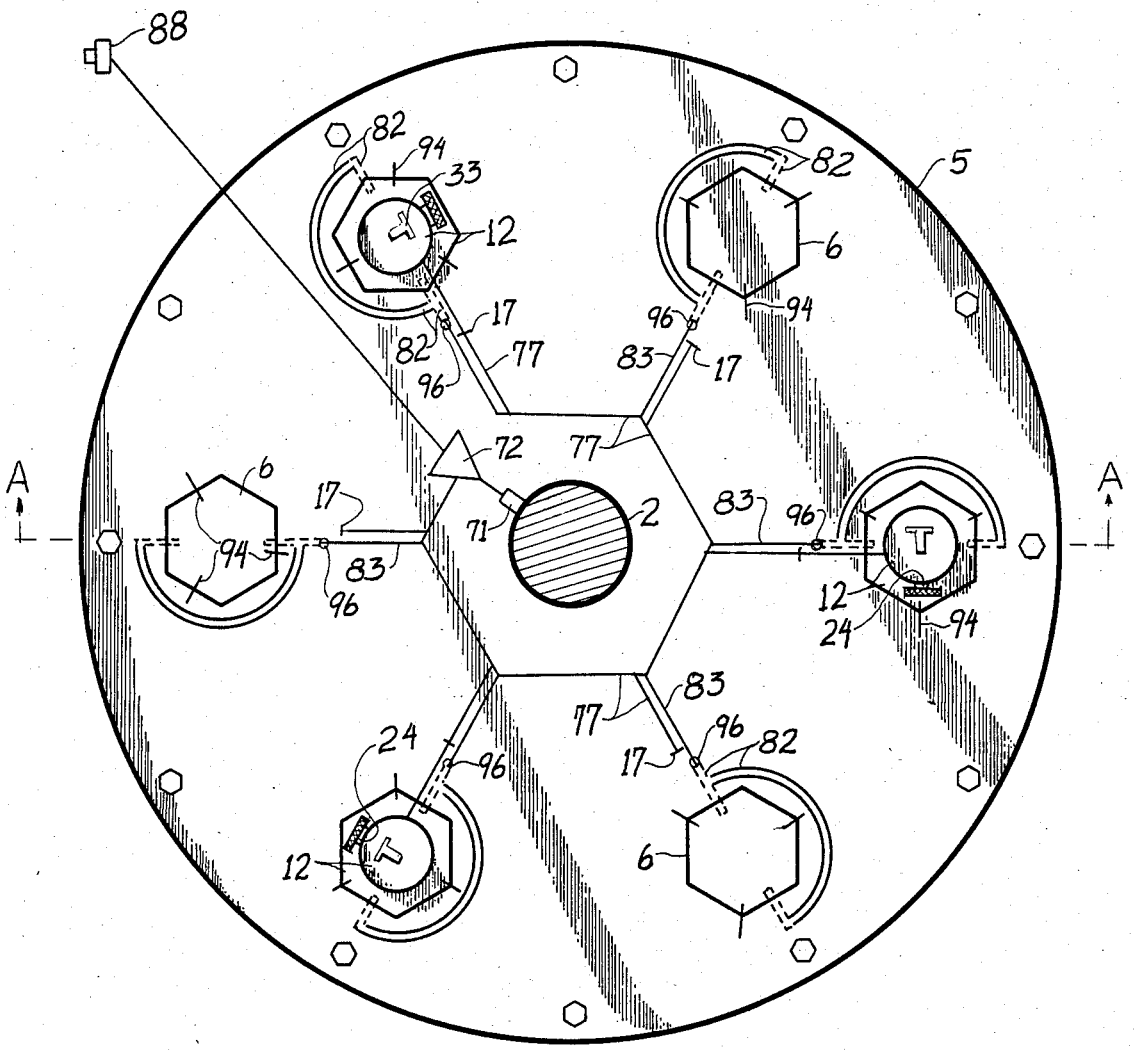
FIG. 1 is a top plan view of the main engine housing in one variation showing a microprocessor in relation to the main parts that it controls.
Figure 2:
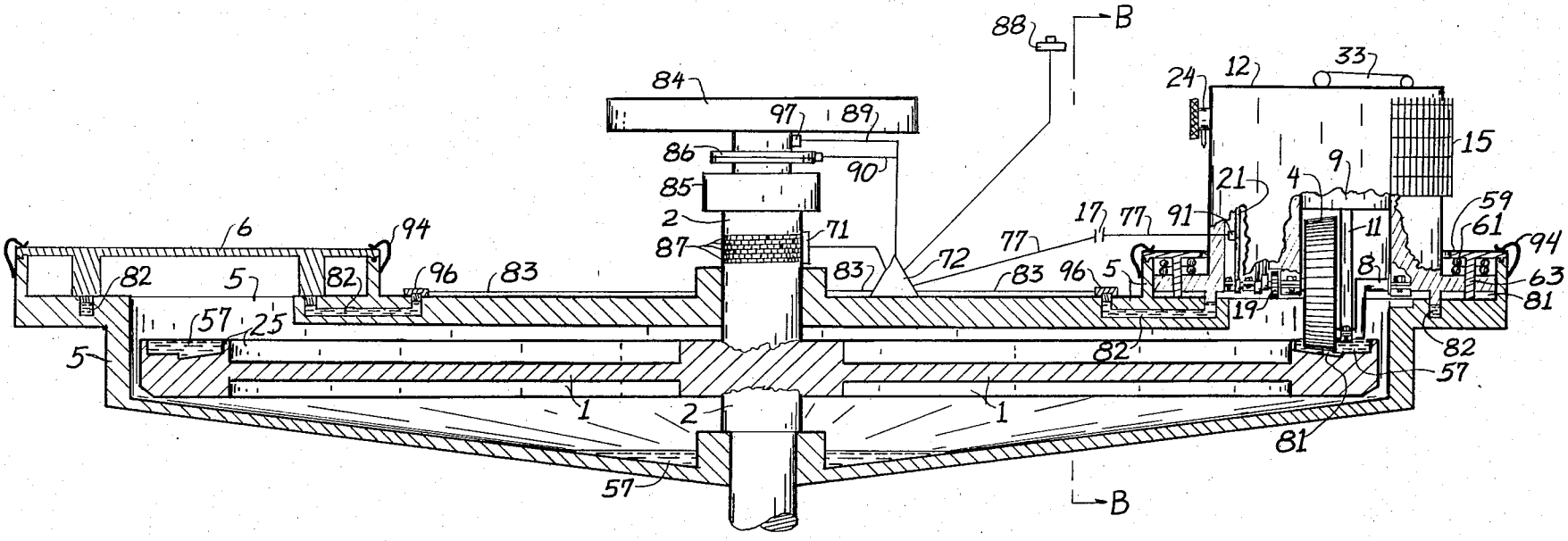
FIG. 2 is a vertical cross section approximately along line A—A of FIG. 1.

FIG. 1 shows a plan view of a hollow pancake shaped main housing 5 with a power output shaft 2 journaled through the center. Disposed radially around the center are six positions on the housing 5 for installing replaceable power modules 12. Aperture covers 6 are shown in place of three removed units 12. Quick release clips 94 couple the units 12 and covers 6 to the housing 5. The easily replaceable power units with housing 12 are shown in FIG. 2, connected to the main engine housing 5 by the clips 94. The depicted power units are the 4 cycle spark piston type, however, they are not so restricted. They may be of different types that are capable of powering a takeoff means such as shaft 8 which is selectively connected or disconnected to an engine's power shaft 2, shown in FIG. 1 and FIG. 2. Suggested alternative units could be rotary, diesel or electrical motors.

The depicted power units are self-contained, having a piston 9 in cylinder 3. Coolant circulates through conduit 14 and radiator 15, however, other means are known in the art for regulating temperature of the units 12. A handle 33 can be used to manually insert or remove the lightweight unit 12. A carburetor 24 with air cleaner may be installed on each unit 12, as shown, or there may be a central carburetor, fuel injection or other means for regulating fuel to the cylinder 3. Conventional linkages may be used between the carburetor and operator's accelerator.

Piston rod 11 couples piston 9 to crankshaft 8 through the eccentric pin 50 and the crank arm 104. Pinion gear 4 is shown with counterweight 7, although this counterweight could also be incorporated as part of crankshaft 8.

Shaft 8 has a second gear that meshes 19 with a gear on camshaft 18. Cams on shaft 18 conventionally operate push rods 27 that cause rocker arms to reciprocate over head valves in the well known manner. Shaft 8 is coupled to housing 12 by bearings 29. Camshaft 18 is similarly coupled to housing 12. The reciprocating piston 9 rotates gear 4 and shaft 8. Shaft 8 causes camshaft 18 to rotate through the gear mesh 19. The gears and other parts are lubricated by an oil pump (not shown) which draws from oil sump 57 shown in FIG. 2. A splash cup on the bearing of rod 11 also conventionally lubricates and cools the walls of cylinder 3. An oil sump 57 is maintained between the pair of concentric walls 25 on top of gear 1 to lubricate gears 1 and 4 as shown in FIG. 3. This sump is maintained by the dripping oil from the power unit 12. Ports can be made in the outside wall 25 to discharge overflow to the lower sump shown surrounding shaft 2 in housing 5. Gear 1 can be spoked or have holes inside the periphery of the inner wall 25 to allow the collected oil to drip through to the lower sump 57.

Camshaft 18 rotates cam 93 which raises contact rod 21. Spring 26 loads rod 21 to follow the surface of cam 93. This acts to keep the position of rod 21 constantly synchonized with the position of piston 9. Rod 21 is tipped with a replaceable electrical conductor and this conductor is connected to an electrical source through conductor 22. Upon contact with the opposing replaceable conductor end, a charge is sent through conductor 95 to spark plug 30. The gear ratios at mesh 19 and cams on camshaft 18 are dimensioned to synchronize the movement of piston 9 with firing of plug 30 to effect proper timing.

A gear mesh occurs between ring gear 1 and pinion gear 4 to enable the power unit 12 to drive ring gear 1 and, thereby, drive the engine's output power shaft 2. Gear 1 may be coupled to shaft 2 through a spline joint. Notice, in FIG. 1 that more than one power unit 12 may be simultaneously meshed to gear 1 through gear 4 to drive shaft 2. The power units 12 are kept properly timed relative to each other through the engagements between each unit's gear 4 and the ring gear 1.

Rod 21 has precisely positioned sensor marks 92 along its length which are independently sensed relative to each other by the stationary sensor 91. These sensor marks are synchronized with the position of piston 9. As the rod 21 reciprocates along its length, the sensor marks 92 shift accordingly which is detected by sensor 91. Sensor 91 is connected to microprocessor 72 through conductor 77. Conductor 77 passes through a common junction 17 with conductor 22. The processor 72 receives the position of piston 9 from the sensor 91 by the independently recognizable marks 92. In practice, this is easily accomplished by programming processor 72 to recognize one of the marks 92 as being unique; for instance, corresponding to the firing position of piston 9. A counter in processor 72 is set to zero at this point and incremented by one—corresponding to each successive mark detected by sensor 91—until the known maximum number is counted at which time the piston 9 is again in firing position and the counter is reset to zero. The processor 72 has real time input of the position of piston 9 at all times during operation. When the engine is shut down, the porcessor 72 may store the sequence number of the last mark 92 sensed by sensor 91. In this way, the processor 72 will immediately know the position of piston 9 upon restarting the engine. This procedure is duplicated for each of the power packs 12. When power packs 12 are removed and replaced by covers 6, the electrical conductors 22, 77 are disconnected at the common junction 17. This causes a lack of signal from sensor 91 which the processor can correctly interpret as a removed power pack 12 and it could display this information to an operator.

There are also sensor marks 87 on shaft 2 as shown in FIG. 2. These marks 87 are included in rings around shaft 2 so that each ring corresponds to a particular unit 12. Each of the sensor marks 87 in a particular ring relates to its counterpart mark 92 on shaft 21. In each ring, one of the marks 87 is uniquely identifiable as relating to the mentioned unique firing position mark 92 on shaft 21. A second counter in processor 72 is incremented by one as each successive mark 87 is sensed by sensor 71 until the maximum number is reached when this counter is also reset to zero corresponding to the uniquely identifiable mark 87 that relates to the firing position mark on shaft 21. The processor now has the real time data input to know if piston 9 is properly timed with ring gear 1 through the mesh between gear 1 and gear 4. The processor can correlate this information from these real time mark inputs received from each of the sensors 91 in each unit 12 to ascertain the proper timing between the multiple units 12. It will be seen upon further perusal that the processor 72 will effect the proper timing between units 12 even if they should be out of time; for instance, when incorrectly installed.

A hydraulic line 82 is shown. There is an electronic/-hydraulic interface 96 between line 82 and an electrical conductor 83 leading to the processor 72. This interface 96 permits the logic of processor 72 to lift the unit 12 with the hydraulics 82 to cause separation of gear 1 and gear 4 by the clearance 81, which is shown exaggerated in FIG. 3. The interface 96 can be designed according to techniques known in the art. When displaced by the hydraulic action, unit 12 is guided by the post 63, shown at each of the two places in FIG. 3, and is forced against springs 61. Springs 61 are held fast by post 63 and part 59. Part 59 is shown rigidly fastened to housing 5 by clips 94. This arrangement permits units 12 to be suddenly raised enough to separate gear 1 from gear 4 under control of processor 72. This results in the clearance 81 between gear 1 and gear 4. While separated, unit 12 is kept in position by posts 63 and housing 5 so that it can be suddenly released exactly into its former position to effect timely reengagement between gears 1 and 4. Releasing the hydraulic pressure at interface 96, under control of processor 72, allows springs 61 to quickly apply downward force to the unit 12 to mesh the gears with proper timing while the engine is operating. These gears could be synchromeshed.

Disengagement of gear 1 and gear 4 is not critical to engine timing. When disengaged, fuel flow, under control of processor 72, will be immediately stopped which will cause unit 12 to completely shut down. However, timing is very critical when engaging gear 1 and gear 4 to effect fuel efficiency and maximize power. Processor 72 logic has the exact position of piston 9 for reasons already explained. The logic also knows the position of the moving gear 1 in real time. The logic is programmed to anticipate the delay between release of the hydraulic pressure in line 82 and reengagement of gears 1 and 4. The programming is simplified if the ratios of the diameters of gear 1 and gear 4 can be made to be whole numbers, i.e. 1:1, 2:1, etc. The delay will probably be about 38 ms. The processor logic will release the hydraulic pressure at interface 96 when a sensor mark 87 is detected that is 38 ms prior to the mark corresponding with gear 1 teeth at the point of engagement with gear 4. Since the logic also knows the real time rotation rate of gear 1 through sensor 71, it would make timely reengagement of the gears in spite of varying rotation rates. State of the art processor 72 is all that is required.

Normally, processor 72 would automatically determine when to engage or disengage gear 1 and gear 4 by comparing, for instance, shaft 2 rpm with a throttle opening through a sensor (not shown) or comparing the differences in brake line hydraulic pressure with a sensor (not shown). These methods or other techniques known in the art, would satisfactorily measure load on shaft 2 well enough to enable a logical determination to engage gear 1 and gear 4 to increase power at shaft 2 or disengage them to reduce power and save fuel. However, there may be occasions when operator override of the logic might be desired. This can be done with state of the art operator controlled switch 88 which is connected to the logic of processor 72 as shown in FIG. 2. This switch 88 could offer the operator several override options.

Figure 4:
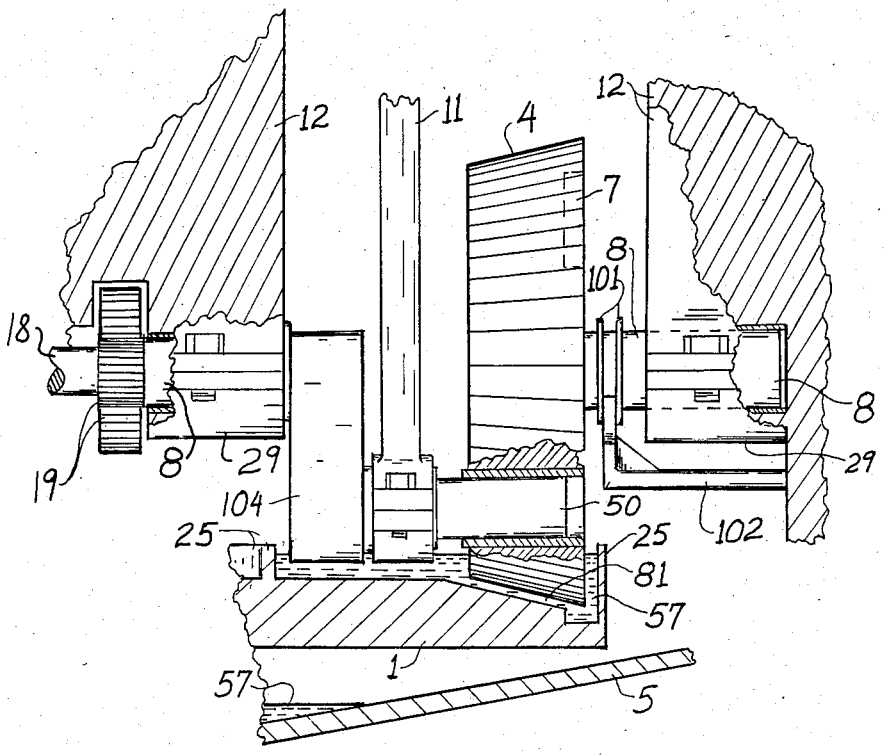
FIG. 4 shows a variation for coupling/decoupling the ring and pinion gears with the use of slip joints and a control arm with parts broken away.

FIG. 4 shows a variation for coupling and decoupling the pinion gear 4 and ring gear 1 which uses a slip joint between pin 50 and gear 4 in combination with a slip joint between shaft 8 and bearings 29 on housing 12. There is a collar 101 on shaft 8 which is operatively coupled to the control arm 102. The arm 102 may be actuated through electronically controlled hydraulics as previously explained. The piston rod 11 is coupled to the crank pin 50 on crank arm 104 of shaft 8 through conventional bearings. The pinion gear 4, with conventional bushings, houses pin 50 to form the slip joint. It can be seen that the pinion 4 is slidable under control of arm 102 without sliding the piston rod 11. As pinion 4 slides to the right in FIG. 4, it disengages from ring gear 1 without moving the rest of the power unit 12. When pinion 4 is disengaged, unit 12 is shut down as previously explained to save fuel. As control arm 102 slides the pinion 4 to the left, it engages the moving gear 1 and this action reciprocates the piston 9 to start the power unit 12 in a manner similar to conventional engines.

Figure 5:
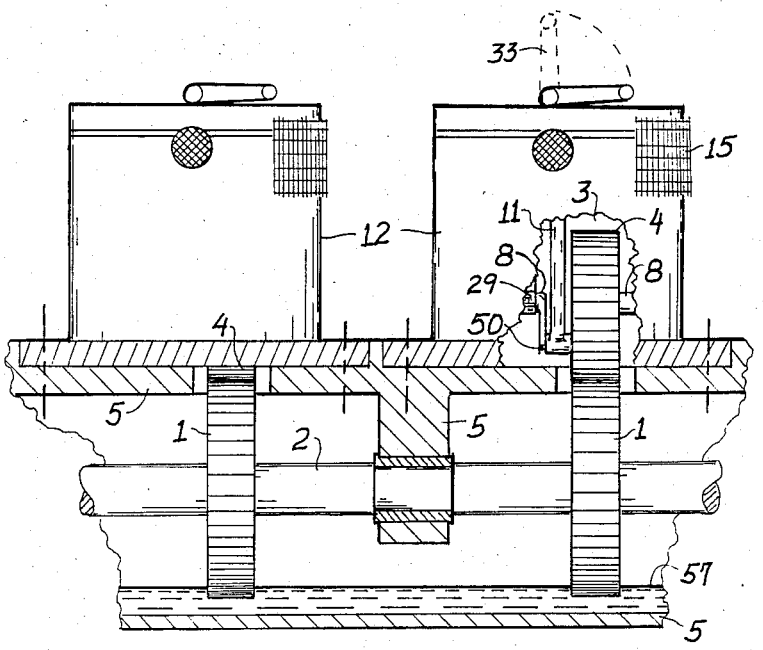
FIG. 5 shows another variation of the invention in elevation, partly in cross-section and partly in perspective, with parts broken away.

With respect now to FIG. 5, another variation of the invention is shown where the pinion gears 4 are meshed in spur arrangement with the ring gears 1. It is obvious that more than one gear 4 may be meshed with a single ring gear 1 and there may be more than one ring gear 1 disposed along the axis of rotation of the power shaft 2. The power units 12 are shown attached to the engine housing 5 with bolts as might be anticipated for the variation shown in FIG. 4.

In all variations, the power modules 12 can be removed and replaced by a simple lightweight cover 6 as shown in FIG. 1 and FIG. 2 and the invention will still operate with the same fuel efficiency but, of course, consuming less fuel and offering less power at shaft 2.

Quick release fasteners, such as fastener 94, can separate conductor 77 at junction 17; fuel and oil lines; exhaust conduit; and the links to carburetor 24. This enables an inexperienced person to easily and quickly remove and reinstall modules 12.

This invention is also capable of storing regenerated energy in flywheel 84 shown in FIG. 2. The processor 72 controls clutch 86 through conductor 90 and measures the rotation of the shaft of flywheel 84 through its connector 89 to sensor 97. A speed reducer 85 is shown on shaft 2 but it may be omitted in some applications. The processor logic—knowing the load on shaft 2 by means already explained—is able to use the flywheel 84 to store regenrated energy by engaging clutch 86 and, alternatively, releasing the energy upon demand at shaft 2. The regenerated energy could be stored in flywheel 84 when a decelerating vehicle is noted by the processor 72 through a combination of high speed shaft 2 and a closed throttle, or operator override through switch 88. In this circumstance, the processor 72 might be programmed to disengage gear 4 and gear 1 for all power units 12 and engage clutch 86. If the decelerated vehicle stops, the processor 72 may also disengage the clutch, leaving the flywheel 84 rotating while keeping the units 12 disengaged and shut down to conserve fuel. Upon acceleration of the vehicle, the clutch 86 may be reengaged to release the stored energy to the drive train to overcome the vehicle's initial inertia. When the speed of flywheel 84 reaches a predetermined minimum, as detected by sensor 97, the gear 1 and gear 4 would be engaged by processor 72, as previously explained, to provide power at shaft 2 from the power units 12. This feature of the invention would be particularly desirable for conserving fuel on stop and go vehicles such as city buses.

It is to be understood that the form of the invention herewith shown and described is not to be taken as the only variations of the embodiment of the invention. Various changes may be made in the shape, size and arrangement of the parts. Equivalent elements may be substituted for those illustrated and described herein; parts may be reversed and certain features of the invention may be utilized independently of the other features, all without departing from the intent or scope of the invention as defined in the claims hereto. Examples of changes that may be made to the forms described without departing from the intent or scope of the invention include, but are not limited to, the following:

1. Gear 4 and gear 1 may be traction wheels.
2. Springs 61 may be replaced by hydraulics.
3. A dog clutch may be used in the engagement and disengagement of gear 1 and gear 4.
4. Other methods known to the art may be used to maintain proper timing of the parts.
5. Cylinder 3 may be an integral part of housing 5 and it may have a replaceable head.
6. The power takeoff means 2 may be actuated to effect coupling and decoupling with the gear 4.
7. Housing 5 may be spoked with lightweight covers between the spokes to save weight.
8. In powering helicopters, the shaft 2 may be extended upward to become the rotor shaft.
9. Exhaust pipes from unit 12 may have connections using quick release fasteners similar to those used on vice grips.
10. Thermal control of certain types of units 12 may be effected in several ways that, for brevity, are omitted herein but are known to the state of the art.

We claim:

1. An apparatus for transmitting drive to a driven shaft, the combination comprising:

a first housing;

the first housing rotatably supporting the driven shaft;

the driven shaft comprising the crankless type;

at least one power unit of the internal combustion type;

the power unit including a casing, an output drive means, power generated by the internal combustion, a timing means for synchronizing the internal combustion with the output drive means, a second means for transmitting the power from the internal combustion to the output drive means;

a first connection means for operatively coupling the power unit to the first housing;

a second connection means for transmitting drive between the output drive means and the driven shaft;

a control unit;

a first set of indicators presented to the control unit, the first set indicating a first variable condition of the combination;

a second set of indicators presented to the control unit, the second set indicating a second variable condition of the combination;

the control unit adapted to receive and process at least the first and second sets;

the control unit further adapted to determine a result from the process; and the control unit further adapted to communicate with the power unit for controlling said second connection means whereby at least the second communication is effected dependent upon the result of the control unit.

2. The combination of claim 1 wherein:

the output drive means further includes a pinion gear rotatably supported by the power unit;

a disengageable gear mesh between the pinion gear and the driven shaft;

the second connection means further includes a solenoid;

an urging means for actuating the pinion gear to engage or disengage the gear mesh;

the control unit communicating with the solenoid to effect operative control thereof; and the solenoid adapted to actuate the urging means whereby the gear mesh is selectively engaged and disengaged by the control unit to control the drive to the driven shaft.

3. The combination of claim 2 in which the control unit comprises an electronic processor.

4. The combination of claim 2 wherein:

the power unit further comprises the valve and piston type including a second housing having at least one cylinder therein, the second housing operatively connected to the first housing, the internal combustion having a sequence of power steps, the output drive means including a second shaft rotatably supported by the second housing and the pinion gear non rotatably secured to the second shaft, the second connection means comprises a rod operatively coupling the piston to the pinion gear for transmitting drive to the pinion gear, a cam shaft rotatably supported by the second housing, the second shaft engaging the cam shaft for transmitting drive thereto, valves operatively supported by the second housing, the timing means operatively coupling the valves and the cam shaft for synchronous operation of the valves with the power steps to effect the power to the piston, the timing means adapted to present the second set of indicators, a first sensing means adapted to sense the first set; the driven shaft adapted to present the first set; a second sensing means adapted to sense the second set; and the control unit adapted to communicate with the first and second sensing means to receive the two sets.

5. The combination of claim 4 wherein the timing means comprises rods or chain.

6. The combination of claim 2 which includes a plurality of diameter ratios between the pinion gear and the driven shaft.

7. The combination of claim 1 wherein:

the drive means includes a first traction wheel;

the driven shaft is adapted to non rotatably secure a second traction wheel; and the first traction wheel is engageable with the second traction wheel to transmit the drive therebetween.

8. The combination of claim 7 which includes a plurality of diameter ratios between the first and second traction wheels.

9. The combination of claim 2 wherein the combination further comprises:

a device adapted for manual communication, the manual communication including input and output data;

means for transmitting the data between the control unit and the device; and the control unit adapted to receive the data for inclusion in the process whereby the control unit effects manual control of the second connection means dependent upon the result.

10. The combination of claim 9 wherein the device comprises an ignition switch whereby the manual control is effected through on or off input data from the ignition switch.

11. The combination of claim 9 wherein:

the solenoid includes an energizing means;

the control unit communicates with the solenoid to regulate the energizing thereof;

the urging means comprises a hydraulic drive forming an operative couple between the solenoid and the power unit; and the plunger actuated by the solenoid whereby the control unit selectively effects engagement and disengagement of the gear mesh.

12. The combination of claim 11 wherein:

the hydraulic drive communicates with the power unit for shifting the position of the power unit slightly apart from the first housing while remaining attached thereto at the urging of the hydraulic drive whereby the control unit shifts the power unit to engage and disengage the gear mesh.

13. The combination of claim 11 wherein:

the output drive means further comprises a crank shaft having a crank and crank pin;

the crank shaft rotatably supported by the casing;

the pinion gear coaxial with the crank shaft, the crank pin having slidable engagement with the pinion gear;

the pinion gear non rotatably supported by a stub shaft;

the stub shaft rotatably supported by the casing so as to be axially shiftable;

the stub shaft having a collar;

a forked shaft rotatably engaging the collar through a fork near one of its ends;

the plunger operatively engaging the opposite end of the forked shaft for actuating the forked shaft along its axis to cause the stub shaft to be shifted through the engaging collar; and the axial shift of the stub shaft moves the pinion gear in relation to the driven shaft whereby the control unit selectively effects engagement and disengagement of the gear mesh to control the drive therebetween.

14. The combination of claim 1 in which the first connection means includes quick release fasteners for manually removing or replacing the power unit.

15. The combination of claim 2 or 9 wherein the combination further comprises:

at least one energy storage rotor rotatably supported by the first housing;

an operative linkage between the energy storage rotor and the driven shaft for transmitting the drive therebetween;

a third set of indicators presented by the energy storage rotor;

a third connection means between the energy storage rotor and the control unit for transmitting the third set to the control unit;

the control unit adapted to receive the third set for inclusion in the process;

a fourth connection means between the operative linkage and the control unit for selectively actuating the operative linkage to transmit the drive; and the energy storage unit accumulating the drive as energy whereby the control unit urges the fourth connection means to transmit drive between the driven shaft and the energy storage rotor dependent upon the result.

16. The combination of claim 1 or 15 wherein the combination further comprises:

the first, second and third sets comprise electrical pulses;

at least one moveable element and at least one static element, the moveable element and static element juxtaposed;

a conductor part of the moveable element, the conductor part insulated from the moveable element;

a pair of conductors secured to the static element, the pair being mutually insulated;

one of the pair charged; and the conductor part periodically displaced by the moveable element so as to bridge the pair whereby the electrical pulses are obtained.

17. The combination of claim 15 wherein:

the energy storage unit includes a flywheel;

the operative linkage unit includes a clutch and a speed changing device; and the energy is transmitted between the flywheel and the drven shaft through the operative linkage.

18. The combination of claim 17 wherein the fourth connection means comprises:

a solenoid;

a hydraulic means further comprising a plunger actuated by the solenoid; and a conductor for connecting the solenoid and the control unit whereby the control unit selectively actuates the plunger to manipulate the clutch for selectively effecting drive between the flywheel and the driven shaft.

19. The combination of claim 4 wherein the power unit comprises a four cycle single cylinder spark piston engine having:

a spark plug engaging the cylinder so as to cause the internal combustion;

a conductor for transmitting electrical charge to the spark plug;

the conductor having a first part and a second part with facing juxtapositional ends;

a closeable adjustable point gap between the facing ends; and the point gap operatively coupled to the cam shaft whereby the drive of the cam shaft adjusts the point gap so that the charge is transmitted to the spark plug during the compression stroke of the piston at a time to cause internal combustion to effect the timing means.

* * * * *